United States Patent [19]

Bennett

[11] 4,143,822

[45] Mar. 13, 1979

[54] VALVE STEM BUTTON

[76] Inventor: Robert A. Bennett, 170 Sturbridge Rd., Easton, Conn. 06425

[21] Appl. No.: 858,953

[22] Filed: Dec. 9, 1977

[51] Int. Cl.[2] ..... B05B 1/34

[52] U.S. Cl. ..... 239/490; 239/590.3

[58] Field of Search ..... 239/337, 490, 491, 573, 239/589, 590.5; 222/394, 564

[56] References Cited

U.S. PATENT DOCUMENTS

| | | | |
|---|---|---|---|
| 3,008,654 | 11/1961 | Abplanalp et al. | 239/337 X |
| 3,095,127 | 6/1963 | Green | 239/573 X |

FOREIGN PATENT DOCUMENTS

| | | | |
|---|---|---|---|
| 86837 | 3/1966 | France | 239/337 |
| 6502402 | 8/1966 | Netherlands | 239/337 |

*Primary Examiner*—Robert B. Reeves
*Assistant Examiner*—Andres Kashnikow

[57] ABSTRACT

A valve stem button comprises a vertically elongated hollow body having a lateral face disposed between the top and bottom thereof, the face having a recess, the recess having an outlet port. A valve stem receiving socket is disposed in the bottom of the body and extends upwardly to a position intermediate the top and bottom of the body. A vertical cylindrical chamber having a closed cylindrical inner wall is disposed in the body intermediate the top of the socket and the top of the body, the wall having an inlet port aligned with but spaced from the outlet port, the chamber having a vertical axis. A horizontal straight conduit is disposed between and interconnects the inlet and outlet ports, the conduit having a horizontal axis which intersects the chamber axis to define a vertical plane therewith. A vertically elongated cylindrical member extends downwardly from the top of the member in the chamber, the lower end of the member being spaced above the top of the socket, the diameter of the member being smaller than that of the chamber, the member being spaced from the inner wall, the member having a vertical axis lying in the vertical plane and offset from the chamber axis, the member axis being disposed between the axis of the chamber and the inlet port, the lower end of the member having an inlet orifice, the outer cylindrical surface of the member having an outlet orifice spaced horizontally from the inlet port, the member containing a second conduit interconnecting the inlet and outlet orifices.

6 Claims, 8 Drawing Figures

VALVE STEM BUTTON

PRIOR ART STATEMENT

Valve stem buttons for use with aerosol dispensers using Freon gases are well known as taught for example in U.S. Pat. Nos. 2,884,207, 2,962,228 and 3,008,654.

BACKGROUND OF THE INVENTION

The use of Freon gas in aerosol dispensers has been sharply curtailed and will be even further curtailed because of adverse publicity and governmental regulation. Various substitutes for Freon used in low pressure aerosol dispensers now include carbon dioxide and various hydrocarbons. Known valve stem buttons as currently used with Freon employing dispensers have been found to be not completely satisfactory when used with the low pressure dispensers employing the substitutes referred to above: the resultant discharge is non-homogeneous, containing large drops from time to time rather than being a fine homogeneous mist. Moreover, the solid angle of dispersion at the point of discharge is reduced and as a result, the area of coverage at optimum distance from the point of discharge is reduced below that desired.

The present invention overcomes these difficulties.

SUMMARY OF THE INVENTION

This invention is directed toward a valve stem button for use with low pressure aerosol dispensers employing carbon dioxide or various hydrocarbons as the gaseous vehicle.

In accordance with the principles of this invention, the valve stem button employs a vertically elongated hollow body having a lateral face disposed between the top and bottom thereof. The face has a recess therein in which is disposed an outlet port. A valve stem receiving socket is disposed in the bottom of the body and extending upwardly therein to a position intermediate the top and bottom of said body. A vertical cylindrical chamber having a closed cylindrical inner wall is disposed in said body intermediate the top of the socket and the top of said body. This wall has an inlet port aligned with but spaced from said outlet port. A horizontal straight conduit is disposed between and interconnecting said inlet and outlet ports. This conduit has a horizontal axis which intersects the vertical axis of the chamber to define a vertical plane therewith. A vertically elongated cylindrical member extends downwardly from the top of the member in the chamber. The lower end of the member is spaced above the top of the socket. The diameter of the member is smaller than that of the chamber. The member is spaced from the inner wall and does not touch it at all. The member has a vertical axis lying in said vertical plane and offset from the chamber axis. The member axis is disposed between the axis of the chamber and said inlet port so that the separation between the inner wall and the adjacent surface of the member in the region of the inlet port is substantially less than the separation between the inner wall and the adjacent surface of the member at a point on the wall spaced about one hundred and eighty degrees from the inlet port.

The lower end of the member has an inlet orifice. The outer cylindrical surface of the member has an outlet orifice spaced horizontally from the inlet port. The member contains a second conduit interconnecting the inlet and outlet orifices.

In use the button disposed vertically with the socket at the bottom is connected to a low pressure aerosol dispenser using carbon dioxide or hydrocarbons as gaseous vehicles. The valve stem is disposed at the upper end of the dispenser, which is held vertically, and extends upwards into the socket.

The discharge orifice in the stem is disposed horizontally at the top of the stem and, when the valve is properly positioned, this discharge orifice is disposed adjacent but below the inlet orifice of the member. When the valve is depressed, there is a swirling action and pressure buildup causing an ultrafine breakup and the production of a fine homogeneous mist at the outlet port in the recess. A cone of dispersion is produced with a solid angle of dispersion substantially larger than obtained with conventional valve stem buttons.

The swirl and pressure buildup occurs because of the geometry employed.

DETAILED DESCRIPTION OF PREFERRED EMBODIMENTS

Figure 1:
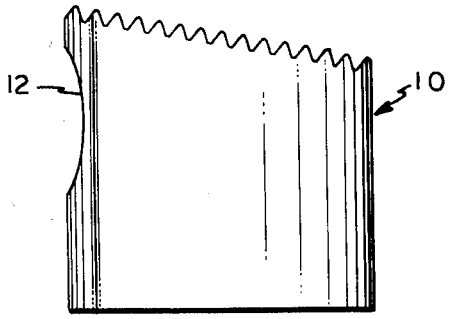
FIG. 1 is a side view of a valve stem button in accordance with the invention.

Referring now to FIGS. 1-5, a valve stem button 10 formed of conventional plastic materials has a horizontal bottom end, an inclined top end which is ribbed to promote ease of finger engagement and operation, and a lateral face having a recess 12. This recess approximates half of an ellipsoid which as viewed in a vertical plane is vertically elongated. The recess is provided with an outlet port 14 centered therein. The button as shown in top view has the shape of a football with one end cut away, but this shape is chosen for appearance. The conventional circular cylinder shape can be employed without change in operation.

The button is hollow and contains a cylindrical valve stem rceiving socket 16 disposed in the bottom of the body of the valve which extends upwards to a position intermediate top and bottom of the body. The horizontal diameter of the socket is selected to enable the valve stem of the dispenser 18 to fit tightly therein with.

A vertical cylindrical chamber 20 having a closed cylindrical wall is disposed in the body intermediate the top of the socket and the top of the body. The vertical axis of chamber 20 is aligned with that of the socket but the diameter of the socket for example 0.155 inches is larger than that of the chamber which for example is 0.145 inches. The socket can be, for example, 0.100 inches deep while the chamber can be 0.330 inches deep.

The inner wall of the chamber contains an inlet port 22 spaced from but aligned with port 14. Both ports can be circular openings having like diameters for example of 0.015 inches. A horizontal hollow conduit of like diameter to that of the ports extends between and interconnects these ports as shown at 24. This conduit for example can be 0.010 inches long. A horizontal centerline or axis of the conduit if extended will intersect the vertical axis of the chamber and will define a vertical plane therewith. This vertical plane, if the influence of the inlet and outlet orifices and interconnecting conduit (which will be described below) is neglected, constitutes a vertical plane of symmetry of the body.

A vertical cylindrical member 26 having a horizontal diameter for example of 0.095 inches extends downwardly within the chamber from the top of the body to a position above the top of the socket. The vertical axis of the member is coplanar with the horizontal axis of conduit 24 and the vertical axis of the chamber but is disposed between the vertical axis of the chamber and inlet port 22. The net result is that the separation between the outer surface of member 26 and port 22 is a minimum for example 0.01 inches while the separation between the outer surface of member 26 and the inner wall of the chamber at a point on the wall spaced one hundred and eighty degrees away from port 22 but horizontally aligned therewith is a maximum, for example 0.04 inches.

The lower end of the member is shaped to approximate an inverted truncated vertical cone by having three concentric circular grooves 28 cut therein. These grooves are equidistantly spaced as viewed horizontally and as viewed vertically are of like depth. A vertical slit 32 cut into the member has a bottom opening in the lower end of the member and opposite vertical openings 34. The bottom opening constitutes an inlet port, openings 34 constitute an outlet port, and the body of the slit 32 constitutes a conduit interconnecting inlet and outlet ports.

Figure 5:
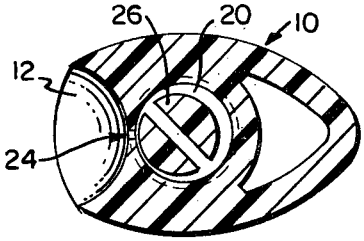
FIG. 5 is a view taken along line 5—5 in FIG. 4.
Figure 3:
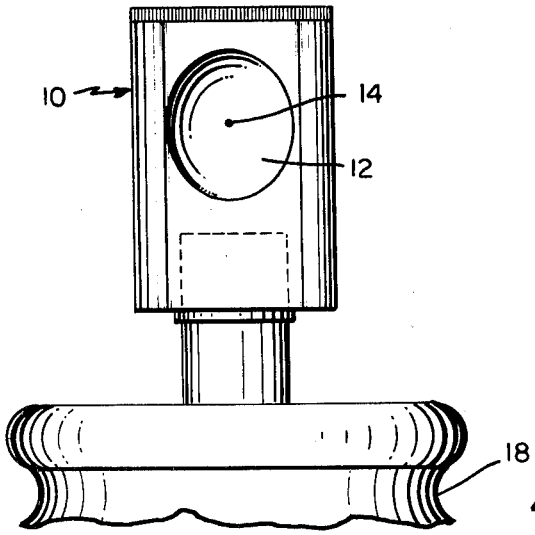
FIG. 3 shows the button of FIG. 1 in position on a dispenser and rotated through 90° as compared to FIG. 1 to show the outlet port.

It will be seen from FIG. 5 that the horizontal axis of conduit 24 intersects the vertical plane of the slit 32 at an acute angle which is optimum at about forty five degrees. It is immaterial whether this vertical plane is disposed as shown in FIG. 5 or is rotated through ninety degrees from that shown.

The lower end of the member is spaced from the top end of the socket for example by 0.160 inches.

When the valve stem button is in position on the valve stem of the dispenser and is depressed, the mixture of the gaseous vehicle and the entrained material to be dispensed is discharged vertically upwards from a horizontal discharge port in the top of the stem. This mixture strikes the lower end of the member and the grooves and is subjected to an initial breakup, with a small portion of the mixture entering the slit directly and other portions striking the grooves and dropping downward to mix with the upwardly directed portions of the initial discharge. These mixed portions rise up in the slit and are discharged in the space between the member and the inner wall of the chamber. Due to the geometry, a swirling action and pressure buildup developes whereby the ultimate discharge via inlet port 22, conduit 24 and outlet port 14 has the desirable characteristics previously described.

Figure 4:
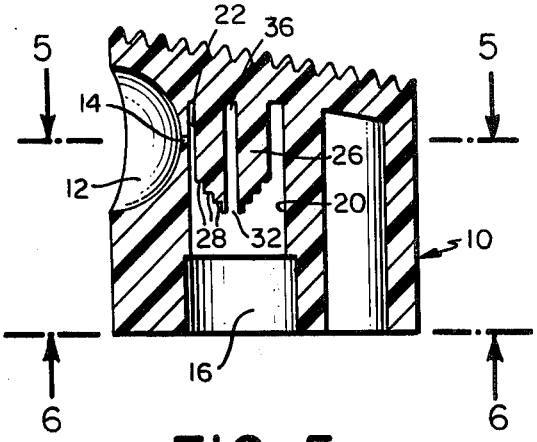
FIG. 4 is a vertical cross section of the valve of FIG. 1.
Figure 2:
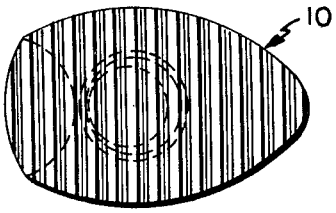
FIG. 2 is a top view thereof.
Figure 6:
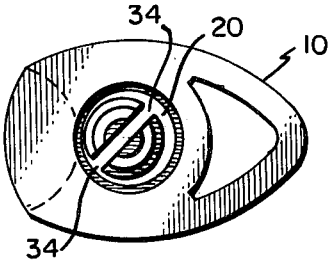
FIG. 6 is a view taken along line 6—6 in FIG. 4.
Figure 7:
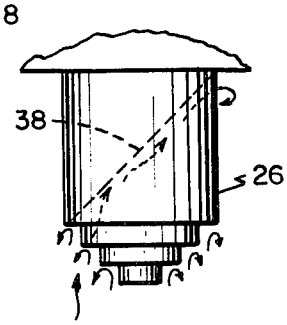
FIG. 7 is an enlarged detail view showing one modification of the invention.
Figure 8:
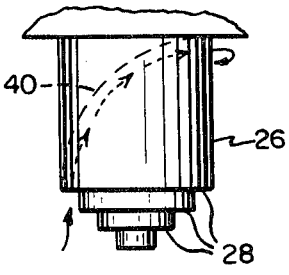
FIG. 8 is an enlarged detail view of another modification of the invention.

The slit in FIGS. 4–6 has a top horizontal edge shown at 36 in FIG. 4. In the modification of FIG. 7, this edge is vertically inclined at a constant angle as shown at 38 and in the modification of FIG. 8, this edge is vertically inclined at an always decreasing angle as shown at 40. The operation is not appreciably changed by these modifications.

The slit can have a width for example of 0.020 inches and the separation between opening 32 and edge 36 can be for example 0.170 inches.

What is claimed is:

1. A valve stem button comprising:

a vertically elongated hollow body having a lateral face disposed between the top and bottom thereof, said face having a recess therein, said recess having an outlet port therein;

a valve stem receiving socket disposed in the bottom of the body and extending upwardly therein to a position intermediate the top and bottom of said body.

a vertical cylindrical chamber having a closed cylindrical inner wall and disposed in said body intermediate the top of the socket and the top of said body, said wall having an inlet port aligned with but spaced from said outlet port, said chamber having a vertical axis;

a first horizontal straight conduit disposed between and interconnecting said inlet and outlet ports, said first conduit having a horizontal axis which intersects the chamber axis to define a vertical plane therewith; and a vertically elongated cylindrical member extending downwardly from the top of the member in the chamber, the lower end of the member being spaced above the top of the socket, the diameter of the member being smaller than that of the chamber, the member being spaced from the inner wall, the member having a vertical axis lying in said vertical plane and offset from the chamber axis, the member axis being disposed between the axis of the chamber and said inlet port, the lower end of said member having an inlet orifice, the outer cylindrical surface of said member having an outlet orifice spaced horizontally from the inlet port, said member containing a second conduit interconnecting the inlet and outlet orifices.

2. The button of claim 1 wherein said second conduit is a vertical slit lying in another vertical plane, the horizontal axis of the second conduit intersecting said another plane at an acute angle.

3. The button of claim 2 wherein said lower end of the member is provided with a plurality of concentric circular grooves whereby said lower end approximates an inverted truncated vertical cone.

4. The button of claim 3 wherein said recess approximates one half of an ellipsoid.

5. The button of claim 4 wherein said ellipsoid as viewed in a vertical plane is vertically elongated.

6. The button of claim 5 wherein said angle is optimum at about forty five degrees.

* * * * *